US005450926A

United States Patent [19]

Fraser

[11] Patent Number: 5,450,926

[45] Date of Patent: Sep. 19, 1995

[54] CHECKOUT COUNTER ORDER DIVIDER INCLUDING MERCHANDISE TO BE PURCHASED

[76] Inventor: William A. Fraser, 3001 Audubon Ter., NW., Washington, D.C. 20006

[21] Appl. No.: 385,518

[22] Filed: Feb. 8, 1995

[51] Int. Cl.[6] ..... A47F 9/02; B65D 25/54

[52] U.S. Cl. ..... 186/59; 206/45.34; 206/459.1; 206/526; 426/104; 116/214

[58] Field of Search ..... 186/52, 55, 56, 59, 186/60; 116/214; 206/45.34, 459.1, 526; 426/87, 104, 112

[56] References Cited

U.S. PATENT DOCUMENTS 2,647,334 8/1953 Wilsher et al. ..... 426/87 X
4,094,406 6/1978 Zietzschmann ..... 206/45.34 X
4,387,809 6/1983 Botzler ..... 426/87 X
4,445,611 5/1984 Shofu ..... 206/45.34 X
4,534,126 8/1985 Gilman .
4,972,953 11/1990 Friedman et al. ..... 206/459.1
5,358,134 10/1994 Ripley et al. ..... 206/45.34 X

*Primary Examiner*—Michael S. Huppert
*Assistant Examiner*—Scott L. Lowe
*Attorney, Agent, or Firm*—Lowe, Price, LeBlanc & Becker

[57] ABSTRACT

A checkout counter order divider bar includes merchandise to be purchased and which is displayed through transparent walls of the divider bar. A customer signals an operator at the checkout counter orally or visually that he/she wants to buy the merchandise in the divider bar or by activating a signalling device on the order divider bar.

46 Claims, 5 Drawing Sheets

CHECKOUT COUNTER ORDER DIVIDER INCLUDING MERCHANDISE TO BE PURCHASED

FIELD OF INVENTION

The present invention relates generally to an apparatus for and method of purchasing products from a checkout counter and, more particularly, to such a method and apparatus wherein an order divider contains a product to be purchased and a customer signals that he/she is desirous of purchasing the product in the order divider.

BACKGROUND ART

Checkout counters are widely used in certain types of retail establishments, such as supermarkets and in stores of certain mass merchandisers. A typical checkout counter includes a cash register and a conveyor for merchandise to be purchased. Articles to be purchased are loaded, usually by customers, on the conveyor and transported from a position remote from the cash register toward a cash register operator. While an order of a first customer is being processed by the cash register operator, another order is loaded on the conveyor at a position remote from the operator and cash register. Frequently, more than one order is loaded onto the conveyor by two or more customers, while the first customer is being "checked out." To distinguish the orders of different customers, an order divider bar, located in proximity to the conveyor, is inserted by the customers between the items forming the different orders. The order divider bar is typically a piece of molded hard plastic and usually carries the name of the retail establishment. After a customer has been checked out, the divider bar is returned, usually by the checkout counter operator, to a stack adjacent the conveyor.

THE INVENTION

I have realized that an order divider bar can serve as a point of purchase item, such that merchandise desired to be purchased is loaded in the order divider bar. The items to be purchased can be wrapped in a transparent covering, enabling attractive and familiar product wrappings on pre-packaged merchandise, such as appear on candy bars, to be seen by the customer at the time he/she picks up and puts the order divider in place. Alternatively, the order divider bar can include a housing having transparent walls that confine and hold the merchandise in situ. The housing can include prepackaged merchandise, or liquid or particulate type materials, such as fruit juice or candy corn. The housing, typically a plastic container, preferably having a selectively activated closure over an opening so the merchandise therein can be dispensed from it. If the customer desires to purchase the contents of the order divider bar, he/she signals this fact to the operator orally or visually or by activating certain devices included in the order divider bar. Because the prospective purchaser is essentially handling the merchandise in the order divider bar and can see the merchandise or the attractive and familiar packaging therefor, he/she is quite likely to buy the merchandise in the order divider bar.

It is, accordingly, an object of the present invention to provide a new and improved method of and apparatus for facilitating and encouraging purchase of items at a checkout counter.

An additional object of the invention is to provide a new and improved order divider bar for a checkout counter, wherein the order divider bar contains items to be purchased.

An additional object of the invention is to provide a new and improved order divider bar for a checkout counter, wherein the order divider bar includes a structure for signalling that items therein are to be purchased.

An additional object of the invention is to provide a new and improved checkout counter order divider bar which functions both as a divider and as a housing for merchandise to be purchased.

A further object of the invention is to provide a new and improved checkout counter order divider bar which is inexpensive because the vast majority of the mass forming the checkout counter comprises an item to be purchased, to reduce the capital required by a retailer for order divider bars.

An additional object of the invention is to provide a new and improved checkout counter order divider bar containing items such that the order divider bar is relatively stable, to resist displacement once positioned between adjacent orders on a conveyor belt of the checkout counter.

The above and still further objects, features and advantages of the present invention will become apparent upon consideration of the following detailed description of several specific embodiments thereof, especially when taken in conjunction with the accompanying drawings.

DESCRIPTION OF THE PREFERRED EMBODIMENTS

Figure 1:
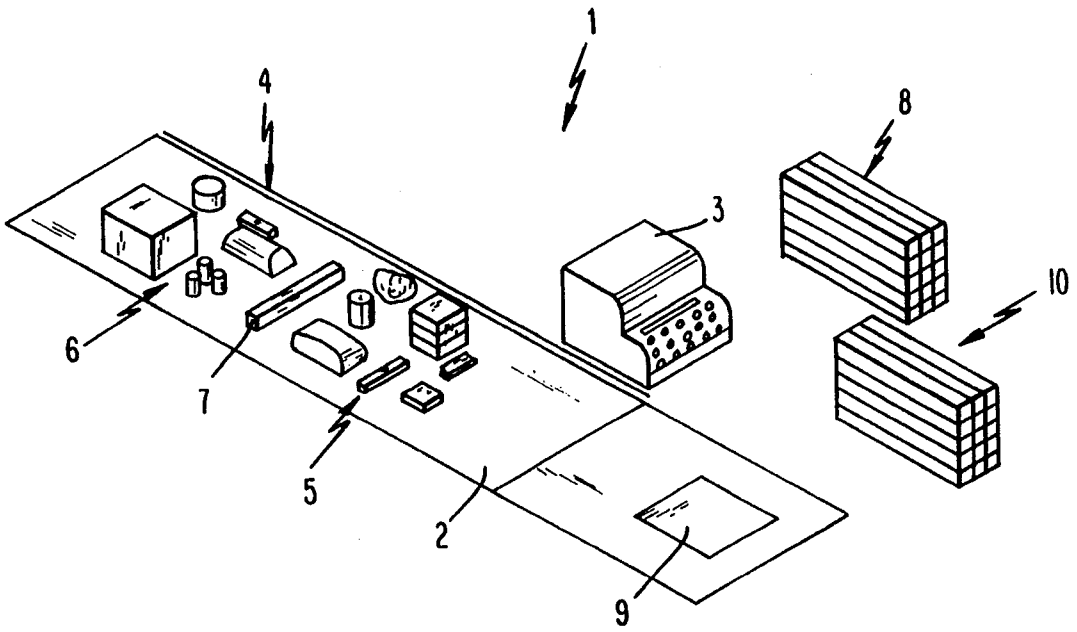
FIG. 1 is a schematic view of a checkout counter including several order divider bars at opposite ends of the counter and an order divider bar in use, in accordance with the present invention.

Reference is now made to FIG. 1 of the drawing, a schematic view of checkout counter 1 including conveyor belt 2 and cash register 3. Orders 5 and 6, located on conveyor belt 2, are separated by order divider bar 7, of the type illustrated in any of FIGS. 2–11. Order divider bar 7 is placed by a customer on belt 2 after having been removed by the customer from track 4 which runs along the checkout counter 2. Order divider bars 7 are placed on this track 4 by the checkout counter operator from the stack 8 of such order divider bars 7. Track 4 is the usual existing track which runs along checkout counters but may, alternatively, be made wider than existing tracks to accommodate order divider bars that are too wide to fit into existing tracks.

Order divider bar 7 has a typical elongated shape, but differs from prior art order divider bars by including merchandise to be purchased. The merchandise is easily seen through an optically transparent housing or wrapping of order divider bar 7. The merchandise included in order divider bar 7 can be of the bulk variety, i.e., particulate or liquid, or it can be prepackaged goods. If the merchandise comprises prepackaged goods, bar code indicia on the package for the goods are visible through the transparent housing or wrapping. If the item in order divider bar 7 is of the bulk variety, a strip bearing bar code indicia associated with the bulk goods is placed inside a housing that forms the exterior of the order divider bar in certain embodiments or such a strip can be bonded to the outside of the housing.

Because the merchandise is visible through the exterior walls or wrapping of order divider bar 7, a customer at checkout counter 1 is likely to decide that he/she desires to purchase the items in the order divider bar. This is particularly true since order divider bar 7 is more than likely to be handled by the customer. The customer places order divider bar 7 between orders 5 and 6 and, when checking out, signals to a checkout counter operator working at register 3 that the items in the order divider bar are to be purchased. Such signalling can be accomplished by oral or visual communication between the customer and the checkout counter operator or it can be performed by activating various signalling devices mounted on the order divider bar, as described infra. In response to the customer signalling to the checkout counter operator that the merchandise in order divider bar 7 is to be purchased, the checkout counter operator places the bar code indicia in the order divider bar above bar code scanner 9, of a type included at a typical checkout counter, and activates cash register 3 in a normal manner.

If the exterior of order divider bar 7 is a housing for the purchased merchandise, the checkout counter operator removes the purchased merchandise from the housing, and then places the housing on stack 10 close to cash register 3 so the order divider bar can subsequently be reloaded with merchandise for further use. Alternatively, if order divider bar 7 includes transparent plastic wrapping, e.g. a shrink wrap sheet, confining and supporting packaged goods to be purchased, the entire order divider bar is placed with the remaining items purchased by the customer. The checkout counter operator then replaces the purchased order divider bar 7 with one taken from stack 8. If the customer does not buy the merchandise in order divider bar 7, the checkout operator returns the order divider bar to track 4.

Figure 2:
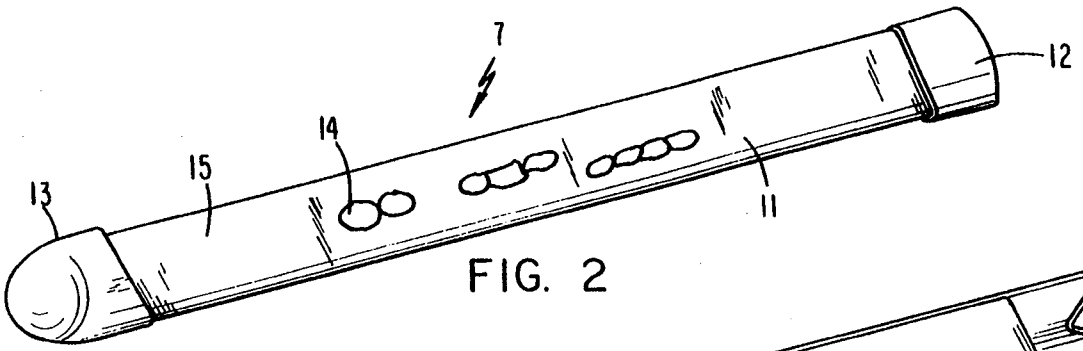
FIG. 2 is a perspective view of a preferred embodiment of an order divider bar in accordance with one embodiment of the invention.
Figure 3:
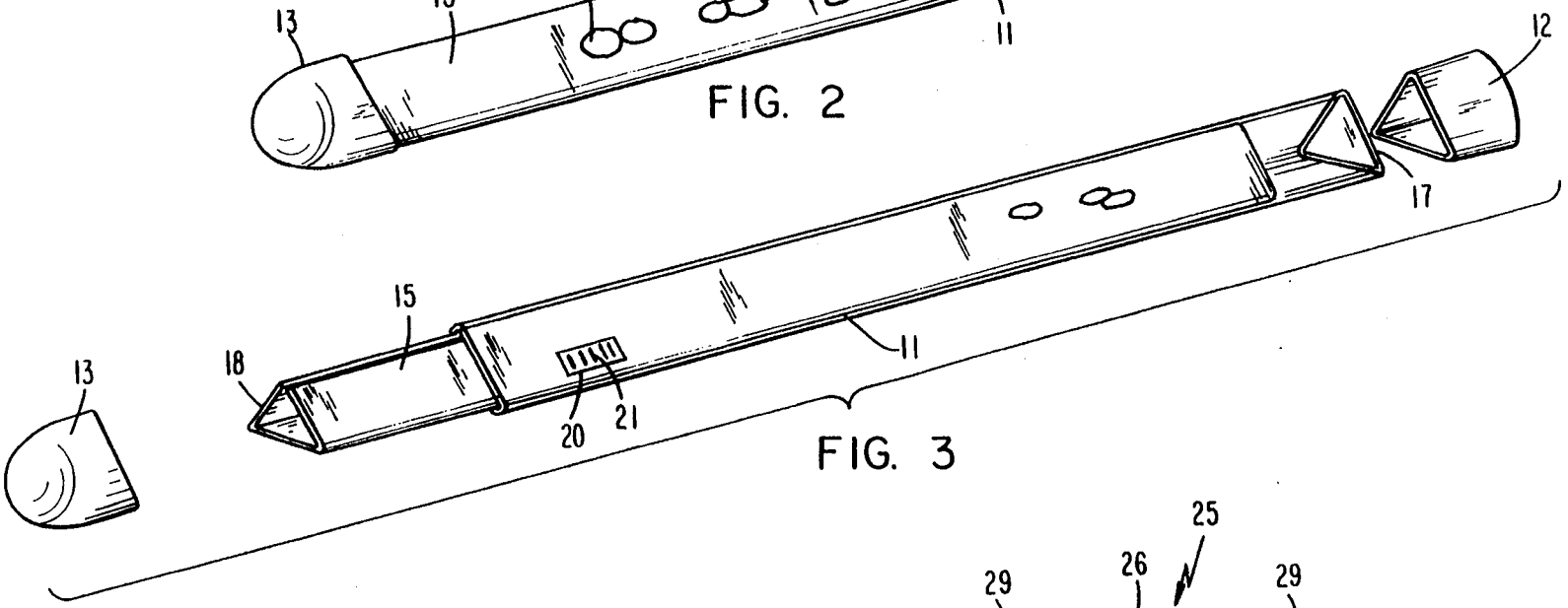
FIG. 3 is an exploded perspective view of the order divider bar illustrated in FIG. 2.

Details of one preferred embodiment of order divider bar 7 are illustrated in FIGS. 2 and 3 as including elongated hollow housing 11 having three stiff side walls 15, together generally having an equilateral triangular cross section and formed of a hard transparent plastic material so merchandise items 14 located within the hollow body can be seen by a person checking out at checkout counter 1; side walls 15 can be planar or bowed inwardly or outwardly. Merchandise items 14 can be packaged items, such as candy bars having trademarks on the exterior wrapper thereof, or bulk, i.e., particulate material, such as certain types of candy or nuts, or liquids. The checkout counter operator removes a closure from housing 11, takes the merchandise items from the housing, and puts the housing in stack 10 for reuse. If the merchandise items are pre-packaged, the packaged merchandise items are included with the remainder of the order being purchased; if the merchandise items are particulate, the particulate material is loaded into another container.

To enable merchandise items 14 to be stored, loaded into and removed from the hollow space between side walls 15, opposite ends 17 and 18 of housing 11, at right angles to side walls 15, are open and selectively closed by closures in the form of end wedges 12 and 13, made of a flexible material, such as vinyl. End wedges 12 and 13 are sized and shaped to frictionally engage the exterior portions of side walls 15 close to ends 17 and 18. Each of end caps 12 and 13 includes a trunk having planar end and side faces and a conically shaped leg that extends from the trunk. The side faces and portions of the legs frictionally engage the exterior surfaces of walls 15 close to ends 17 or 18 to provide a friction closure for one of open ends 17 or 18. In cross section, the chest portion of each of end wedges 12 and 13 has a geometry substantially corresponding to the cross section of housing 11. Preferably, closures 12 and 13, as well as the intersections of walls 15, have somewhat rounded edges to minimize possible injury to a person holding order divider bar 7.

To load or remove merchandise from the interior of housing 11, closure 12 or 13 is removed and then replaced. Merchandise items 14, when inserted into the hollow confines of housing 11, abut the interior surfaces of faces 15. If the merchandise is in a package having bar code indicia, at least one of the packages is placed in housing 11 so the bar code indicia can be seen through one of transparent walls 15 of the housing, to enable the checkout operator to check out the entire contents of housing 11 with one scanning operation. When such packaged merchandise is loaded into housing 11, most of the packages are arranged so merchandise in the package is visible to a prospective buyer and only one package or a small number of packages are placed in the package so the bar code indicia are visible. Alternatively, if merchandise items 14 are of a solid particulate type, strip 20, containing bar code indicia 21, is placed inside housing 11, along one of walls 15, so scanner 9 can automatically signal to cash register 3 the quantity and cost of the particulate merchandise. If merchandise item 14 is liquid, a strip similar to strip 20 is secured to the exterior of one of faces 15. If strip 20 is employed, different strips having different bar code indicia are inserted into housing 11 when the housing is used for different types of bulk merchandise.

The equilateral triangular cross section of housing 11 permits any of side walls 15, all of which have the same area and dimensions, to serve as a base for the divider. Such a structure is inherently stable, when placed on conveyor 2. It is to be understood, however, that other stable structures, such as squares or rectangles, can be employed as the cross sectional configuration of housing 11, and that the housing can have other cross sectional shapes, including circular.

Figure 4:
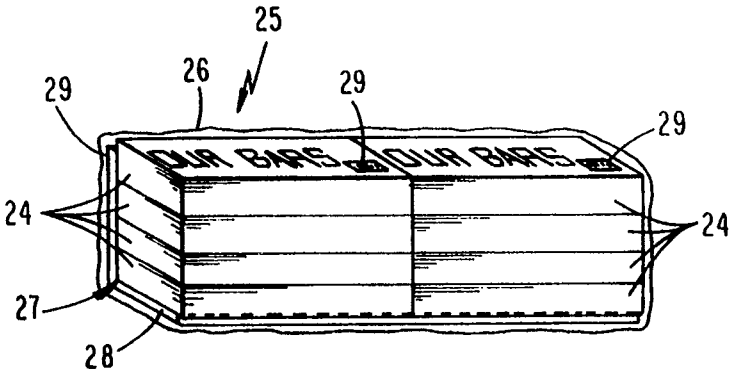
FIG. 4 is a perspective view of another embodiment of an order divider bar in accordance with the present invention, wherein packaged articles are shrink wrapped.

In a second embodiment of the invention, illustrated in FIG. 4, packaged merchandise items 24, particularly candy bars, are stacked together to form a heat, stretch or shrink wrapped package 25, shaped as an elongated right parallelepiped. Package 25 is encased by plastic, transparent heat, stretch or shrink wrapped sheet 26 that abuts candy bar packages 24 and holds them stably in situ. Further structural stability of packages 24 and package 25 is provided by frame 27, formed of any suitable material such as paperboard or a transparent plastic; the latter is preferable because it provides a better and more sales appealing view of packages 24 and enables bar code indicia on the bottom of the packages to be scanned. Frame 27 generally has the same shape as an angle iron, including rectangular base 28 and rectangular upright shoulder 29. Frame 27 has a length slightly less than that of package 25, while base 28 has a width slightly less than the width of candy bar packages 24 and shoulder 29 has a height slightly less than the height of the stack of candy bars 24 in package 25. Bottom faces of the candy bar packages 24 bear against base 28 while one side of each candy bar package in the stack abuts shoulder 29 to provide the desired stability. Candy bar packages 24 are stacked so the trademark thereon is visible through the top face of sheet 26; one of candy bar packages 24 is stacked so bar code indicia 29 thereon are visible through the top transparent face of package 25 or through frame 27.

A person who desires to purchase the merchandise in divider bar 7 signals this desire to the check out counter operator. Such signalling can be accomplished by the purchaser verbally telling the operator of his/her desire to purchase the contents or the purchaser merely pointing to divider bar 7. Alternatively, divider bar 7 can include various aural and/or visual signalling devices, to be described in conjunction with FIGS. 5–10.

Figure 5:
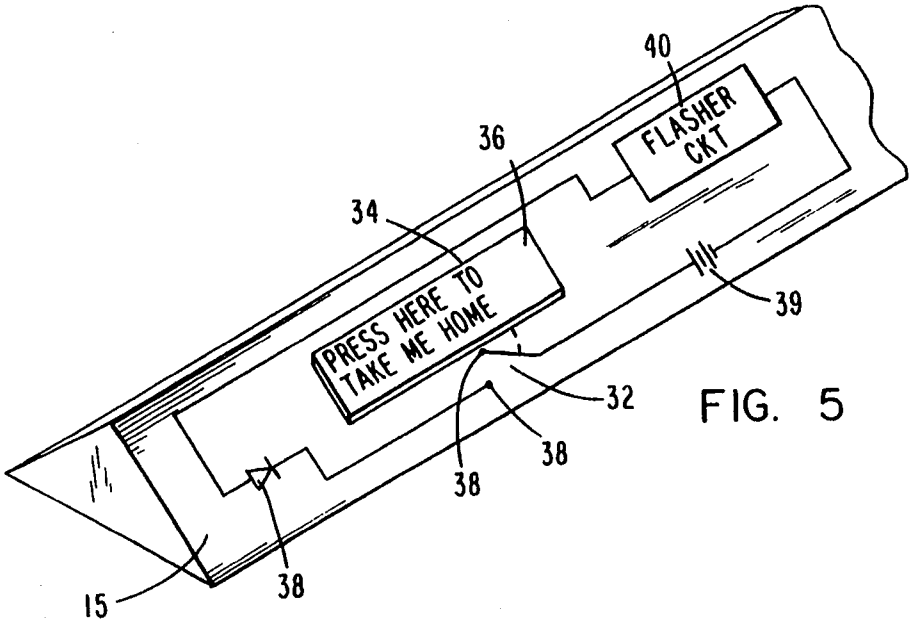
FIG. 5 is a perspective view of a modification of the embodiment of FIGS. 2 and 3, wherein the order divider bar includes an electrically activated visual signalling device.

In the embodiment of FIG. 5, one of side walls 15 of housing 1 has embedded therein an electric circuit including light source 30, in the form of a light emitting diode (LED), in combination with pressure responsive switch 32 having normally open contacts 38. Immediately above pressure responsive switch 32 is indicia bearing strip 34 stating, for example, "PRESS HERE TO TAKE ME HOME," or other suitable indicia to advise the prospective purchaser that the strip should be pressed downwardly. Strip 34 is mounted on flexible plate 36, which, when pushed, closes electrical contacts 38, in series with light emitting diode 30, as well as flasher circuit 40 and battery 39 that are part of the circuit embedded in wall 15. Thereby, in response to plate 36 being pushed downwardly toward the interior of housing 11, LED 30 is periodically turned on and off, i.e., "flashes." It is to be understood that flasher circuit 40 can be replaced by a circuit that constantly energizes diode 30 for a sufficient period, e.g. 30 seconds, to get the attention of the checkout operator. A bulb in a flashlight or in a bare socket, forming part of the purchased items in housing 11, can be used as the light source in lieu of light emitting diode 30. The light source is preferably located behind an eye area of a picture of a person or animal on housing 11 and when energized shines through the wall of the housing to give an effect of a shining or winking eye.

Figure 6:
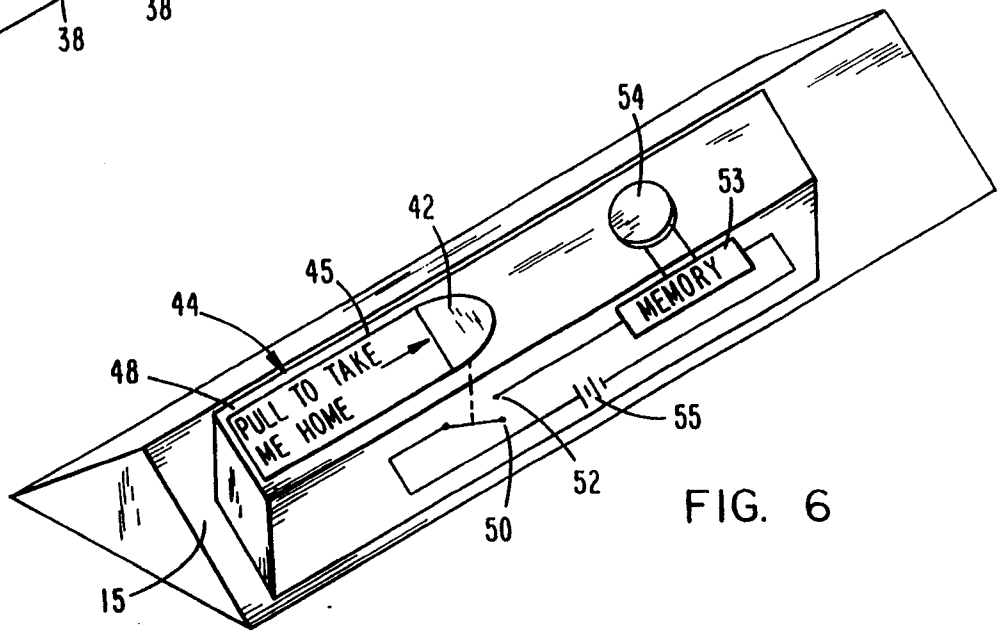
FIG. 6 is a further modification of the embodiment of FIGS. 2 and 3 wherein a pull tab is used as a signalling device and causes activation of an aural signalling device.

According to a further embodiment of the invention, illustrated in FIG. 6, an aural signal is derived in response to the prospective purchaser pulling tab 42 from a region along one of side walls 15 of housing 11. To this end, tab 42 is included in and abuts a wall of case 44, embedded in one of side walls 15. Case 44 also includes strip 45 containing indicia "PULL TO TAKE ME HOME," advising the prospective purchaser that tab 42 is to be lifted or folded from exterior wall 48 of case 44. Alternatively, housing 11 and tab 42 can be constructed so the tab is torn completely from the housing. Case 44 includes normally open switch contacts 50 and 52, electronic memory 53, battery 55 and speaker 54, positioned on the top surface of the case and electrically connected to output terminals of the memory. In response to tab 42 being pulled, normally open switch contact 50 is pulled upwardly away from the interior of housing 15 into engagement with contact 52 to connect battery 55 in circuit with memory 53 which, for example, can be a voice synthesizer having a message such as "THANKS FOR TAKING ME HOME." Memory 53 is thereby activated to periodically supply a voice synthesized signal to speaker 54 to produce an aural signal. Alternatively, the aural signal can be a replica of the sound made by a buzzer, bells, music, thunder or siren. The sound can be associated with the product in housing 11, e.g. a dog barking for dog food or a cat meowing for cat food, or a few bars of the music of a popular television commercial for the product. Hence, memory 53 is activated by closure of contacts 50 and 52 to periodically derive electric waves which are transduced into acoustic waves by speaker 54. The check out counter operator is thereby provided with both visual and aural signals, since tab 42 has been raised and speaker 54 has been activated. Visual signalling can also be provided electrically, as, e.g. in the embodiment of FIG. 5, in combination with electrically activated aural signalling as described in conjunction with FIG. 6.

It is to be understood that other motion responsive signalling devices can be employed. For example a pair of switch contacts can be closed by shaking or tapping housing 11. In such a situation a first message in voice synthesizer memory 53 is activated by closure of the motion responsive switch contacts to supply an aural signal to the prospective customer picking up housing 11 to remind the customer that the contents of the housing are for sale; such an aural signal is "I TASTE GOOD. PLEASE TAKE ME HOME. PULL THE TAB TO LET THE CLERK KNOW YOU WANT TO BUY ME." In such a case, memory 53 includes a second voice synthesized message read from the memory in response to closure of contacts 50 and 52 when tab 42 is pulled. The second synthesized message signals the checkout counter operator that the customer wants to buy the goods in housing 11. Alternatively, the prospective customer can activate a visual signalling device after the initial aural signal.

The checkout counter operator can also stimulate sales of the goods in housing 11 by performing a physical action that causes a pair of switch contacts to close, and provide an aural or other message to the customer that the goods in the housing are for sale. An actuator for such contacts is preferably permanently mounted on housing 11 so the housing can be reused if the customer decides not to buy the contents of the housing in response to the stimulus; a pressure responsive switch, similar to switch 32, FIG. 5, is particularly advantageous. A further alternative is that housing 11 can include a permanent magnet switch contact that is closed in response to the purchaser rubbing ferrous material, e.g. keys, against housing 11; by responding to an instruction on the housing.

Figure 7:
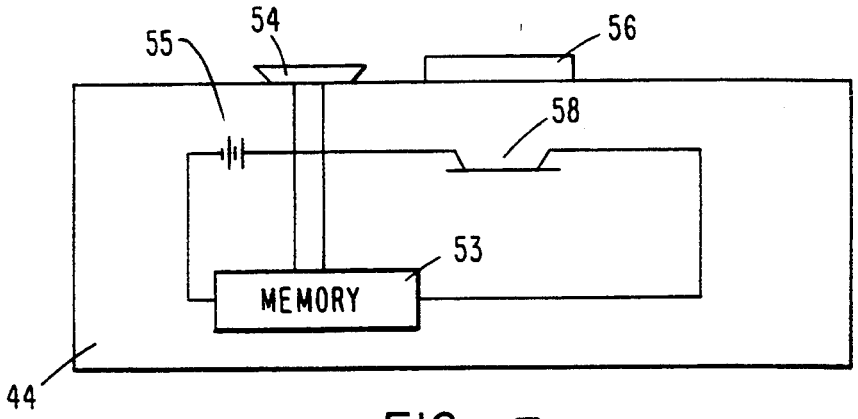
FIG. 7 is a schematic view of a further embodiment wherein a voice synthesizer is activated in response to energization of a light detector.

According to another arrangement, schematically illustrated in FIG. 7, case 44 is modified so tab 56 is a cover for normally reverse biased phototransistor 58 and normally prevents ambient optical energy from being incident on the phototransistor since the tab is opaque to optical energy. When tab 42 is pulled upwardly, phototransistor 58 is exposed to ambient light energy and becomes forward biased. Thereby, memory 53 is connected to battery 55 by forward biased phototransistor 58. Alternatively, phototransistor 58 can be normally covered by an adhesively removable strip (not shown) which is pulled from housing 15 when a checking out customer desires to purchase the merchandise in housing 11. The visual signalling device of FIG. 5 can be combined with switching devices of FIGS. 6 and 7.

Figure 8:
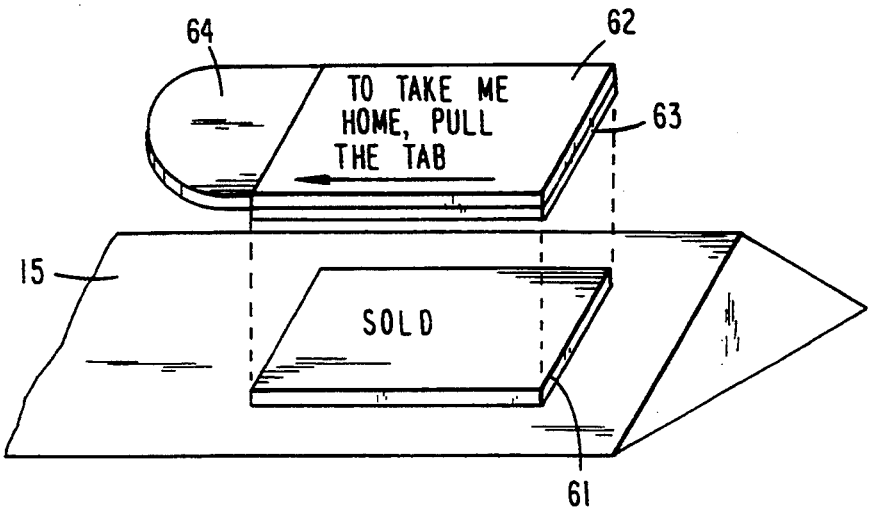
FIG. 8 is an exploded perspective view of a visual signalling device.

An alternate, considerably less expensive signalling device is explosively illustrated in FIG. 8 as including a pair of stacked indicia bearing sheets 61 and 62, arranged so sheet 62 overlaps sheet 61 and bottom face of sheet 61 is adhesively secured to one side wall 15 of housing 11 or one side wall of shrink wrapped sheet 26. The bottom face of sheet 62 includes pseudo-adhesive backing 63, of a type available from 3M and used in POST-IT brand note paper. At one end of sheet 62 is pull tab 64. On the obverse face of strip 61 are indicia, such as the word "SOLD," indicating that the checking out person has decided to purchase the contents of divider bar 7. On the obverse face of top strip 62 are suitable indicia advising the prospective purchaser to pull tab 64 if he/she desires to purchase the contents of the divider; suitable indicia are "TO TAKE ME HOME, PULL THE TAB." When tab 64 is pulled, top strip 62 is pulled from bottom strip 61 and the checkout operator is provided with a signal that the contents of divider bar 7 are to be purchased.

Signalling to the checkout counter operator that the goods in the order divider bar are to be purchased by the customer or signalling to the customer that the goods in the order divider bar are for sale can also be performed by stored voice messages originating from a speaker or optical sources permanently located in the vicinity of the checkout counter. Such signalling is in response to activation of signalling devices on the order divider bar or permanently located in the vicinity of the checkout counter.

Figure 9:
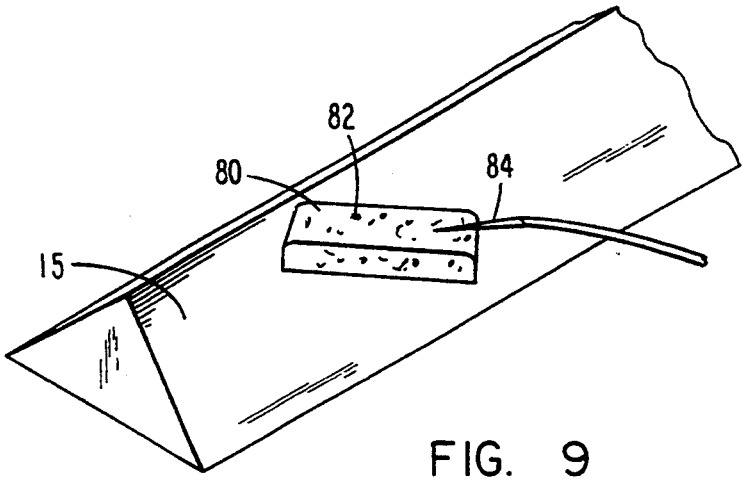
FIG. 9 is a perspective view of a signalling device including a gaseous mass in a frangible capsule.

Another signalling device is illustrated in FIG. 9 as including frangible capsule 80 containing gas mass 82. Capsule 80 is embedded in side wall 15 of housing 11 while capsule rupturing tool 84, shaped similarly to a nail, is secured to side wall 15 by transparent adhesive tape or is integral with a side wall of capsule 80 and pointed toward the interior of the capsule. The gas is released from capsule 80 in response to tool 84 being removed from wall 15 and pushed into and rupturing the capsule by a person desiring to purchase the contents of housing 11. If the rupturing tool is integral with capsule 80, it is merely pushed into the capsule until the capsule breaks. Alternatively, capsule 80 can include a pull tab that normally covers an orifice therein, and the pull tab is removed from the orifice to release gas from the capsule. Capsule 80 also can be made of a very easily crushed material that can be broken without a tool, e.g. thin glass as used in vials for administering gas to fainting victims. The gas released from capsule 80 can chemically react with the air in the vicinity of divider bar 7 to change the color of the air to provide an appropriate signal to the check out counter operator. The gas can chemically react with the air to change the color of the air in the vicinity of the operator or produce a pleasant aroma which the operator can detect. Alternatively, the gas in capsule 80 can have a color or aroma and merely drifts into the air to provide an appropriate visual or aromatic signal to the operator. As another alternative, the air in capsule 80 escapes into housing 11 to change the color of air in the housing, without readily escaping into the atmosphere surrounding the housing.

Figure 10:
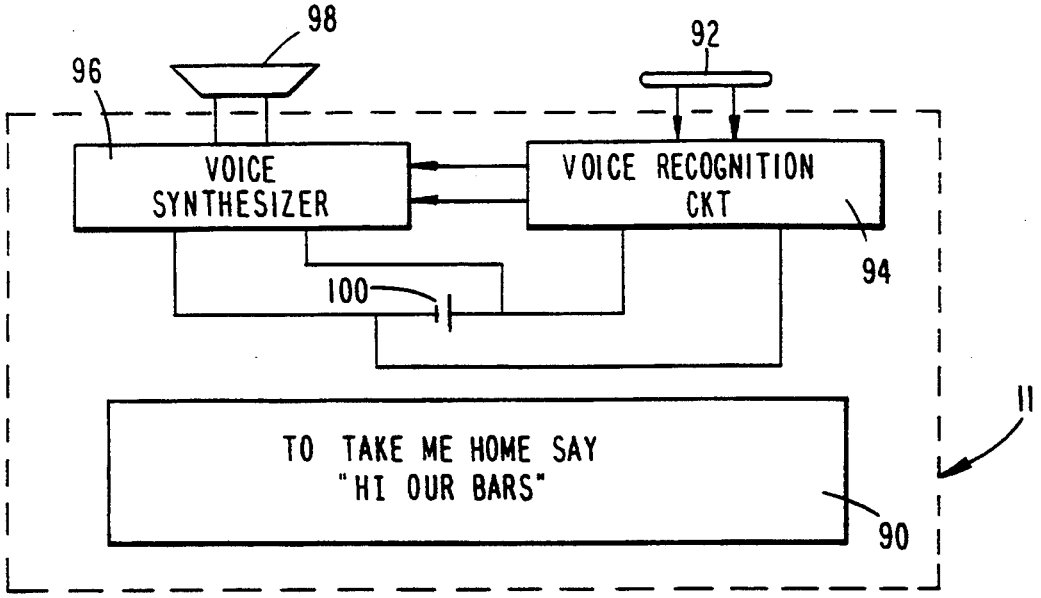
FIG. 10 is a schematic view of another embodiment including a voice recognition circuit responsive to the customer for activating a voice synthesizer signalling device.
Figure 11:
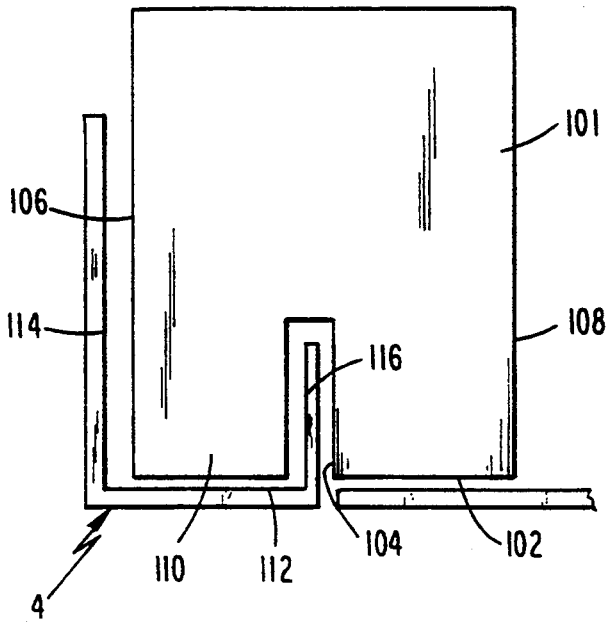
FIG. 11 is a cross sectional view of a modified order divider bar and a conventional track at a checkout counter.

Another embodiment of the invention is schematically illustrated in FIG. 10 as including housing 11 having indicia bearing strip 90 on its exterior. The indicia on strip 90 instruct a prospective customer to say a certain message, e.g. "TO TAKE ME HOME SAY 'HI OUR BARS,'" which is recognized by circuitry in the housing to activate a visual or aural signal that advises the checkout counter operator the contents of housing 11 are to be purchased. The novelty of activating the signal in this manner is likely to induce prospective customers to buy the contents of housing 11. To these ends, the exterior of housing 11 has mounted on it microphone 92 that supplies voice recognition circuit 94 (inside housing 11) with an electric signal that is a replica of the acoustic energy incident on the microphone. In response to the electric signal being somewhat the same as a message stored in circuit 94 (that is the same as the message on indicia strip 90 in quotes, i.e. "HI OUR BARS"), voice recognition circuit 94 energizes voice synthesizer 96 or some other suitable signalling device inside housing 11 to signal the checkout counter operator of the customer's desire to buy the contents of housing 11. Synthesizer 96 drives speaker 98 on the exterior of housing 11. Voice recognition circuit 94 and synthesizer 96 are energized in parallel by the DC output voltage of battery 100.

According to another embodiment the order divider bar housing is modified as illustrated so housing 101 is shaped as a right parallelepiped having base 102 in which is formed elongated slot 104 extending at right angles to base 102 and parallel to side walls 106 and 108 to form leg 110. The spacing of wall 106 and slot 104 and the depth of slot 104 are such that leg 110 can fit in conventional track 4 at checkout counter 1. Track 4 includes base 112 from which extend relatively high and low flanges 114 and 116. Side wall 106 is adjacent side wall 114 while slot 104 has a depth somewhat greater than the height of flange 116. Thereby the position of housing 101 is stabilized as the housing is moved from the vicinity of cash register 3 toward the customer entrance of checkout counter 1 and conventional sized tracks can be used to accommodate housings capable of holding a significant amount of goods.

The order divider bar of the various embodiments of the invention is lightweight, does not roll and is not easily displaced once placed in position between orders 5 and 6 on conveyor belt 2. Because housing 11 and end caps 12 and 13 have rounded corners, the likelihood of injury to a person handling the divider is minimized. Housing 11 is sufficiently strong to resist fracture if dropped during handling; the same is true of the shrink wrap embodiment of FIG. 4. However, the primary benefit of the invention is to increase sales of a retail establishment where the order divider bar is located, by virtue of a person moving through a checkout counter responding to impulse buying psychology.

While there have been described and illustrated several specific embodiments of the invention, it will be clear that variations in the details of the embodiments specifically illustrated and described may be made without departing from the true spirit and scope of the invention as defined in the appended claims. For example the method of the invention can be practiced by using any long narrow item, preferably of the impulse purchase type, as an order divider instead of order divider bar structure specifically designed for that purpose.

I claim:

1. A method of checking out from a checkout counter having a conveyor comprising placing items of an order on the conveyor, placing an order divider at one end of the order, the order divider having at least one merchandise article to be purchased therein, and signalling that the at least one merchandise article in the order divider is to be purchased.

2. The method of claim 1 wherein the order divider includes a housing having an opening with a closure means arranged so the at least one merchandise article can be inserted into and removed from the housing through the opening and further comprising removing the at least one merchandise article from the order divider via the opening while the closure means is not in situ in response to the signalling step being performed.

3. The method of claim 1 wherein the order divider includes a housing having an opening with a closure means arranged so the at least one merchandise article can be inserted into and removed from the housing through the opening and further comprising removing the at least one merchandise article from the order divider via the opening while the closure means is not in situ in response to the signalling step being performed, then loading another merchandise article into the housing via the opening and then closing the opening by inserting the closure means therein.

4. The method of claim 1 wherein the order divider includes a wrapper surrounding the at least one merchandise article and further comprising including with the items of the order the order divider including the wrapper surrounding the at least one merchandise article in response to the signalling step being performed, and then removing the items of the order and the order divider including the wrapper surrounding the at least one merchandise article from the vicinity of the checkout counter after arrangement has been made for payment for the order and the order divider including the wrapper surrounding the at least one merchandise article.

5. The method of claim 1 wherein the signalling step is performed aurally.

6. The method of claim 1 wherein the signalling step is performed aurally by activating a sound source on the order divider.

7. The method of claim 1 wherein the signalling step is performed visually.

8. The method of claim 1 wherein the signalling step is performed visually by activating a light emitter on the order divider.

9. The method of claim 1 wherein the signalling step is performed visually by revealing normally covered indicia on the order divider.

10. The method of claim 1 wherein the signalling is performed by a purchaser making a predetermined utterance in the vicinity of the order divider, a speech recognition device responding to the utterance by activating a signalling device that signals to an operator that the purchaser wants to buy the at least one merchandise article.

11. The method of claim 1 wherein the signalling step is performed by releasing a fluid agent from a capsule in the order divider.

12. The method of claim 11 wherein the released agent causes gas in the vicinity of the order divider to have a perceptible color.

13. The method of claim 11 wherein the released agent causes gas in the order divider to have a perceptible color.

14. The method of claim 11 wherein the released agent causes gas in the vicinity of the order divider to have a perceptible smell.

15. The method of claim 1 further including signalling to a purchaser of the order that the at least one merchandise article is for sale.

16. The method of claim 15 wherein the signalling to the purchaser that the merchandise article is for sale is performed by manipulating the order divider to activate a signalling device with a message indicating the merchandise article is for sale.

17. The method of claim 15 wherein the signalling to the purchaser that the merchandise article is for sale is performed by manipulating the order divider to activate a signalling device on the order divider with a message indicating the merchandise article is for sale.

18. An order divider bar for a checkout counter comprising a housing shaped as an order divider bar of a checkout counter, at least one merchandise article in the order divider, the order divider bar being arranged so that a visible indicator of the at least one merchandise article can be perceived by a prospective purchaser of the at least one merchandise article in the order divider bar.

19. The order divider bar of claim 18 wherein the order divider bar has integrally mounted thereon a means for aromatically signalling to a checkout counter operator that the at least one merchandise article is desired to be purchased.

20. The order divider bar of claim 18 wherein the order divider bar has a base and an elongated slot having a depth extending at a right angle to the base, the slot depth being slightly greater than the height of a flange of a track on which the order divider bar is adapted to be located, the order divider base having a side edge running parallel to the slot and being spaced from the slot such that a leg of the order divider bar between the slot and edge can fit in the track.

21. The order divider bar of claim 18 wherein the order divider bar has integrally mounted thereon a means for visually signalling to a checkout counter operator that the at least one merchandise article is desired to be purchased.

22. The order divider bar of claim 21 wherein the means for signalling includes a light source.

23. The order divider bar of claim 22 wherein the light source includes an electrically activated light emitter, and further including electric circuit means on the order divider bar for activating the light emitter, the electric circuit means including a switch activated in response to manual activity being applied to a structure on the divider.

24. The order divider bar of claim 18 wherein the order divider bar has an optically transparent exterior surface for enabling a characteristic of the at least one merchandise article to be seen from outside the order divider.

25. The order divider bar of claim 24 wherein the at least one merchandise article includes plural stacked packages of merchandise, the stacked packages being arranged as a right parallelepiped, and a transparent plastic wrapping enclosing and abutting the stacked packages to hold the stacked packages rigidly in situ.

26. The order divider bar of claim 24 wherein the order divider bar includes a housing having the optically transparent exterior surface and a hollow interior in which the at least one merchandise article is located.

27. The order divider bar of claim 26 wherein the housing includes an opening arranged to be selectively opened and closed, the opening when opened enabling the at least one merchandise article to be inserted into and removed from the housing hollow interior, and closure means for the opening, the closure means closing the opening so the at least one merchandise article is held in situ in the housing hollow interior.

28. The order divider bar of claim 27 wherein the housing includes an elongated side wall, the side wall including the optically transparent exterior surface, at least one end of the side wall having the opening.

29. The order divider bar of claim 28 wherein the housing has a predetermined cross section, the closure means including an end wedge with a generally planar face having about the same dimensions as the cross section of the housing the end wedge being arranged so it frictionally closes the opening at the at least one end of the side wall.

30. The order divider bar of claim 18 wherein the order divider bar has integrally mounted thereon a means for signalling to a checkout counter operator that the at least one merchandise article is desired to be purchased.

31. The order divider bar of claim 30 wherein the order divider bar has integrally mounted thereon a means for recognizing a predetermined human utterance, said recognizing means activating said signalling means in response to recognition of the utterance.

32. The order divider bar of claim 30 wherein the means for signalling includes a frangible capsule containing an agent which when released from the capsule causes gases in the vicinity of the order divider bar to have a changed characteristic which can be perceived by an operator of the checkout counter.

33. The order divider bar of claim 32 wherein the agent causes the gases in the vicinity of the order divider bar to change color.

34. The order divider bar of claim 32 wherein the agent causes the gases in the vicinity of the order divider bar to change odor.

35. The order divider bar of claim 32 wherein the order divider bar includes a structure thereon for breaking the capsule.

36. The order divider bar of claim 18 wherein the order divider bar has integrally mounted thereon an electrical means for signalling to a checkout counter operator that the at least one merchandise article is desired to be purchased, the electric means including a switch activated in response to manual activity being applied to a structure on the divider.

37. The order divider bar of claim 36 wherein the structure on the order divider bar is pressure responsive and is deflected toward the interior of the order divider bar in response to the manual activity, the switch including normally open contacts that are closed in response to the pressure responsive structure being deflected toward the interior of the order divider bar.

38. The order divider bar of claim 36 wherein the structure on the order divider bar includes a pull tab on an exterior surface of the divider bar, the pull tab being coupled with normally open contacts of the switch that are closed in response to the pull tab being pulled away from an exterior surface of the order divider bar.

39. The order divider bar of claim 36 wherein the switch is activated in response to optical energy being incident thereon, the order divider bar including an opaque member having a normal position covering the switch so ambient optical energy is normally not incident on the switch, the opaque member being selectively removable from its normal position; the order divider bar, opaque member and switch being arranged so ambient optical energy is incident on the switch when the strip is removed from its normal position.

40. The order divider bar of claim 36 wherein the electric means includes a light emitter and a circuit for successively activating the light emitter to on and off states.

41. The order divider bar of claim 36 wherein the electric means includes an aural source.

42. The order divider bar of claim 41 wherein the aural source includes a voice synthesizer.

43. In combination, a checkout counter having a conveyor, plural order dividers at a position accessible to customers loading orders on the conveyor so the customers can put the order dividers on the conveyor between adjacent orders, each of the order dividers including goods that can be purchased by the customers.

44. The combination of claim 43 wherein each of the order dividers includes a housing containing the goods, each of the housings having substantially the same size and shape.

45. The combination of claim 43 wherein each of the order dividers includes a housing, at least some of the housings including an opening and an associated closure that can selectively open and close the opening for enabling repeated insertion and removal of the goods in the housing.

46. The combination of claim 43 wherein each of the order dividers includes a housing, at least some of the housings including a transparent sheet surrounding plural packages containing the goods.

* * * * *